US006026915A

United States Patent [19]

Smith et al.

[11] Patent Number: 6,026,915

[45] Date of Patent: Feb. 22, 2000

[54] EARLY EVALUATION SYSTEM WITH DRILLING CAPABILITY

[75] Inventors: Harrison C. Smith, Anna; Neal G. Skinner, Lewisville, both of Tex.

[73] Assignee: Halliburton Energy Services, Inc., Dallas, Tex.

[21] Appl. No.: 08/950,497

[22] Filed: Oct. 14, 1997

[51] Int. Cl.[7] ..... E21B 49/08

[52] U.S. Cl. ..... 175/50; 166/100; 166/264; 166/66; 73/152.17

[58] Field of Search ..... 166/66, 100, 264; 175/48, 50; 73/152.17

[56] References Cited

U.S. PATENT DOCUMENTS

| | | | |
|---|---|---|---|
| 2,344,598 | 3/1944 | Church | 175/59 |
| 2,725,282 | 11/1955 | Buckley et al. | 73/152.01 |
| 4,387,372 | 6/1983 | Smith et al. | 340/854.6 |
| 4,426,882 | 1/1984 | Skinner | 73/152.52 |
| 4,508,174 | 4/1985 | Skinner et al. | 166/373 |
| 4,525,715 | 6/1985 | Smith | 340/854.5 |
| 4,573,532 | 3/1986 | Blake | 166/264 |
| 4,635,717 | 1/1987 | Jageler | 166/250.01 |
| 4,860,580 | 8/1989 | DuRocher | 73/156.26 |
| 5,228,518 | 7/1993 | Wilson | 166/264 |
| 5,303,582 | 4/1994 | Miska | 73/152.12 |
| 5,337,821 | 8/1994 | Peterson | 166/250.07 |
| 5,467,083 | 11/1995 | McDonald et al. | 340/854.6 |
| 5,473,939 | 12/1995 | Leder et al. | 73/152.12 |
| 5,540,280 | 7/1996 | Schultz et al. | 166/250.07 |
| 5,549,159 | 8/1996 | Shwe et al. | 166/250.02 |
| 5,587,525 | 12/1996 | Shwe et al. | 73/152.52 |
| 5,622,223 | 4/1997 | Vasquez | 166/369 |

FOREIGN PATENT DOCUMENTS

| | | | |
|---|---|---|---|
| 1777029 | 11/1992 | Russian Federation | 175/59 |
| WO 96/30628 | 10/1996 | WIPO . | |
| WO 97/49894 | 12/1997 | WIPO . | |

OTHER PUBLICATIONS

J.J. Pop et al., SPE 26481 Vetical Interference Testing With a Wireline–Conveyed Straddle–Packer Tool, Copyright 1993.

A.R. Smits, et al., SPE 26496 In–Situ Optical Fluid Analysis as an Aid to Wireline Formation Sampling Copyright 1993.

LEE Technical Hydraulic Handbook, Copyrights 1971, 1973, 1976, 1979, 1980,1984, 1987, 1989, 1996.

Carl Gatlin, Petroleum Engineering Drilling and Well Completions, Copyright 1960 (pp. 253–268).

*Primary Examiner*—David Bagnell
*Assistant Examiner*—John Kreck
*Attorney, Agent, or Firm*—William M. Imwalle; John F. Booth

[57] ABSTRACT

A well tool and method are provided for evaluating a subterranean formation through an exposed formation surface, such as the wall of a newly drilled well bore. The tool has a tubular main housing that is connectable into a well work string. A probe and a scraper are extendible from the main housing in response to a first signal of a signal set transmitted from the surface. The probe and the scraper are returnable to the main housing in response to a second signal set transmitted from the surface. The probe provides an isolated fluid conduit from the formation surface to a sensor for measuring a condition in the well. The scraper is for removing debris and for smoothing the formation surface, thereby helping to establish a sealed engagement of the probe to the formation surface. The tool can also be provided with a sampling vessel for taking samples of formation fluids obtained via the isolated fluid conduit in the probe.

26 Claims, 8 Drawing Sheets

300
302
304
306
308
309
310
311
312
313
314
316
317
318
320
322a
322b
322c
324
326
P=P1
P=P0
P=P0
P=P1
Ratchet and Load Spring
TOS
EOS
Ext
Ret
DD

EARLY EVALUATION SYSTEM WITH DRILLING CAPABILITY

TECHNICAL FIELD

This invention relates to the testing of underground reservoirs or formations. More particularly, this invention relates to a method and apparatus for testing and evaluating a downhole formation.

BACKGROUND OF THE INVENTION

During the drilling or completion of oil and gas wells, it is desired to test or evaluate the well's production capacity by isolating the well bore to be tested. Generally, such tests have been performed by logging devices—having semiconductor electronics and probe mechanisms—that are lowered into a well once the drill string has been withdrawn, for either well-completion operations or mid drilling formation surveys. Such tests include formation permeability evaluations made from the pressure change at the well bore formation surface using one or more draw-down pistons. Furthermore, the amount of time, money and resources for retrieving the drill string and running a test rig into the well bore is significant.

An example of a testing system used for well evaluation is provided in U.S. Pat. No. 4,635,717, issued Jan. 13, 1987 to Albert H. Jageler, entitled "Method and Apparatus for Obtaining Selected Samples of Formation Fluids." The testing system disclosed is an inflatable double packer for isolating an interval of the bore hole for removing fluids from the isolated interval. The system is lowered into an uncased bore hole on a conventional wireline after the drilling string has been removed.

But it is highly desirable to conduct early evaluation tests while drilling. That is, without the need to first retrieve the drill string and then make a trip for separate and distinct evaluation apparatus. First, downhole measurements while drilling would allow safer, more efficient, and more economic drilling of both exploration and production wells. Second, being able to evaluate a well repeatedly during the drilling process would allow making earlier development decisions regarding well completion and further tests, and potentially avoiding consumable costs, such as drilling-fluids and drill-bits. Third, tests can be conducted when the formation is freshly penetrated, thus minimizing the likelihood that the tests can be affected by drilling-fluid invasion into the formation. Otherwise, before an uncontaminated sample of connate fluid can be collected, the formation around the well bore that contains forced drilling-fluid filtrates must be "flushed out."

But the detrimental effect of the harsh drilling environment on delicate test equipment has been a strong deterrence for early evaluation systems used in combination with the well drill string. First, drilling string equipment must be capable of withstanding severe subterranean heat and pressure forces compounded by friction, abrasion, and compression, shock, and vibration forces generated along the drill string while rotating and urging a drill-bit into a subterranean formation. Second, a drilling-fluid is circulated under high pressure through the drilling string and back through the annular well bore space surrounding the drill string to cool the drill-bit and to flush formation cuttings to the surface.

Typically, conventional testing devices cannot accommodate high flow rates and a small pressure drop across the tool or variant shock, vibration or torque forces encountered on conventional strings when drilling.

To further complicate the drilling environment, drilling-fluid circulation during well development operations must be maintained because it serves as a first line of defense against a blowout or loss of well control. The circulated drilling-fluid serves to maintain a hydrostatic head or pressure exerted against the well bore surface to contain formation pressure.

Circulating drilling-fluid also helps prevent "stuck pipe," which typically occurs when drilling has stopped for any number of reasons, such as a rig breakdown, or a directional survey or another nondrilling operation. Stuck pipe can occur with the build up of filter cake—a layer of wet mud solids—that form on the surface of the well bore in permeable formations. The hydrostatic pressure of the circulating drilling-fluid can then press the drill string into this filter cake where pressure is lower than the hydrostatic pressure of the drilling mud. That is, the pressure differential between the inner diameter and the outer diameter of the pipe causes the pipe to lodge or stick in the well bore. To limit the chance for stuck pipe, drilling-fluid circulation is maintained to lubricate the pipe string within the well bore, and the pipe is kept moving vertically or rotating.

Conventional wireline test devices are incapable of withstanding the drilling environment. Commonly, wireline devices employ a well bore sealing device, such as a packer, to isolate discrete portions of the well bore to conduct formation testing. First, these sealing devices have expandable elements that cannot endure the frictional forces encountered during drilling, and are typically destroyed by the time they are needed for testing. Second, these sealing devices block the drilling-fluid circulation through the annular space between the drill string and the wall of the well bore, increasing the chances for a well blowout or a stuck pipe string.

Thus, there exists a need for an early evaluation system that can travel with the drilling string for selective deployment and redeployment in the well bore while in the drilling environment.

SUMMARY OF THE INVENTION

Provided is a well tool for evaluating a subterranean formation through an exposed formation surface. The tool has a tubular main housing that is connectable to a well work string, and a probe and a scraper that are extendible from the main housing in response to a signal from a signal set transmitted from the surface. The probe and the scraper are returned to the main housing in response to a signal from the signal set transmitted from the surface. The probe is communicatively coupled to a sensor for measuring a condition in the well. The scraper is for removing formation debris and for smoothing a formation surface, thereby promoting a sealing relation of the probe with the scraped formation surface.

In another aspect of the invention, a well tool is provided for evaluating a subterranean formation in a drilling environment through an exposed formation surface. The tool has a tubular main housing that is connectable to a well work string, and a probe that is extendible from the main housing in response to a signal from a signal set, which is transmitted from the surface. The probe is returned to the main housing in response to a signal from the signal set, which is transmitted from the surface. The probe is communicatively coupled to a sensor for measuring a condition in the well.

Further, the sensor can be contained within an inner bore of the main housing in a selectively removable configuration for replacement, either while the well tool is in the well bore or while the well tool is on the surface. This selectively removable configuration allows alternate sensor configurations for measuring physical characteristics of the subterranean formation. It also allows for replacement of broken sensors with wire slickline devices without having to "trip" the pipe back out of the well bore.

In another aspect, a method of evaluating a well bore formation is provided, wherein an early evaluation tool on a service string is provided. The early evaluation drilling tool has a tubular main housing connectable to the well work string having a probe extendible from the main housing. The probe is communicatively coupled to a sensor for measuring a condition in the well. A scraper is extendible from the main housing for removing formation debris and smoothing a formation surface, thereby promoting a sealing relation of the probe with the formation surface. The scraper is extended against an inner surface of the well bore formation in response to a first signal from the signal set transmitted from the surface. A surface region of the well bore formation is scraped with the scraper by manipulating the well drill string, thereby decreasing well bore debris and smoothing the formation surface. The probe is extended into a sealing relation with the scraped formation surface region. A condition of the formation fluid is sensed with the probe. The scraper and the probe are returned to the main housing in response to a second signal from the signal set transmitted from the surface.

In yet another aspect, a method of evaluating a well bore formation in a well drilling environment is provided, wherein an early evaluation drilling tool is provided coupled to a well drill string having a drill bit. The early evaluation drilling tool has a tubular main housing connectable to the well work string and a probe extendible from the main housing. The probe is communicatively coupled to a sensor that measures a condition in the well. The probe is extended into a sealing relation with the formation surface in response to a first signal from a signal set transmitted from the surface. A condition of a formation fluid is sensed with the probe. The probe is returned to the main housing in response to a second signal from the signal set transmitted from the surface, thereby disengaging the formation surface.

These and other features, advantages, and objects of the present invention will be apparent to those skilled in the art upon reading the following detailed description of preferred embodiments and referring to the drawing.

BRIEF DESCRIPTION OF THE DRAWING

The accompanying drawing is incorporated into and forms a part of the specification to illustrate several examples of the present invention. The figures of the drawing together with the description serve to explain the principles of the invention. The drawing is only for the purpose of illustrating preferred and alternative examples of how the invention can be made and used and is not to be construed as limiting the invention to only the illustrated and described examples. The various advantages and features of the present invention will be apparent from a consideration of the drawing in which.

DETAILED DESCRIPTION OF A PREFERRED EMBODIMENT

Figure 1:
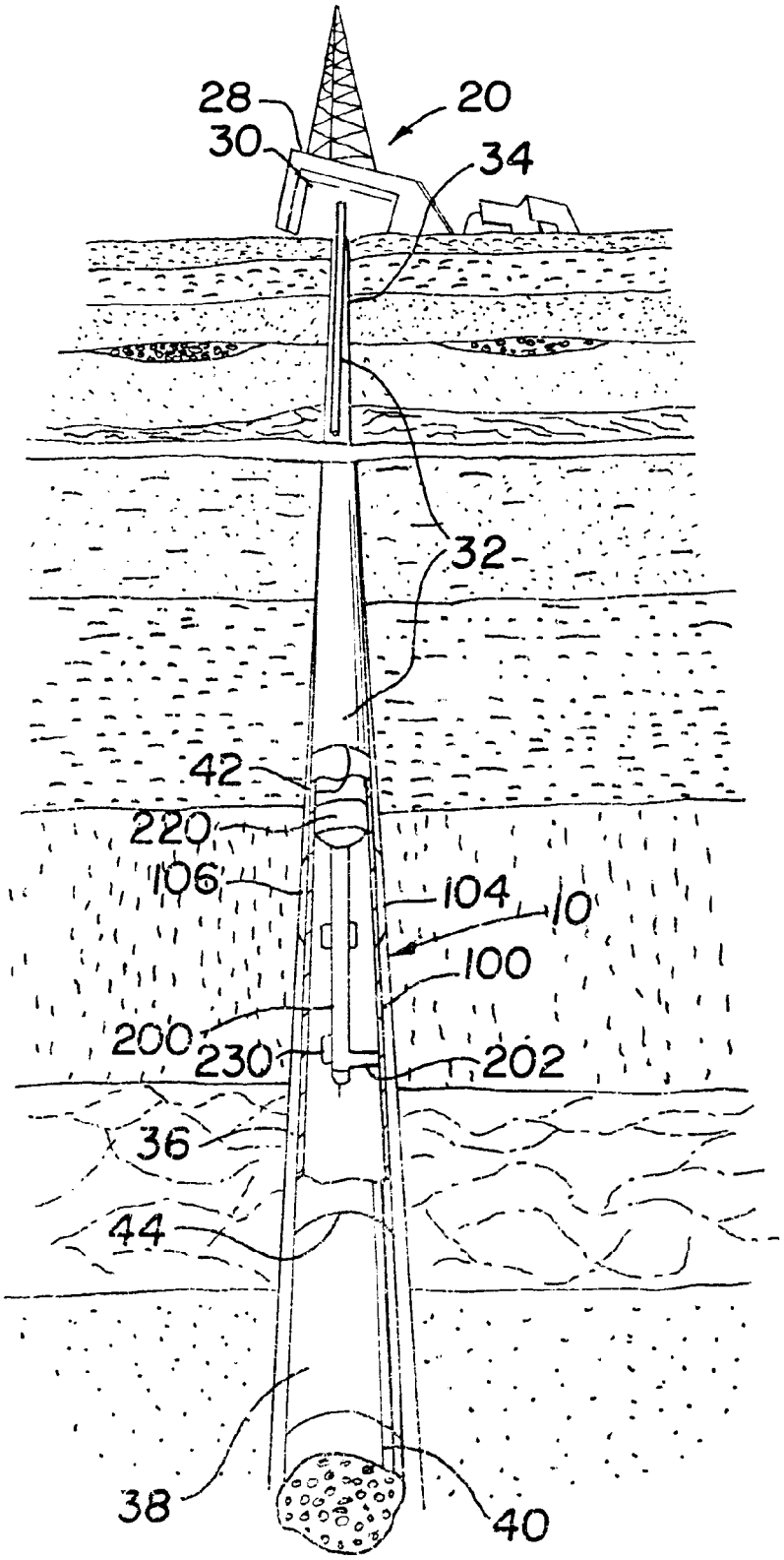
FIG. 1 is a perspective view from the downhole end of a drill string with a drill collar and a coupled early evaluation system (EES) tool of the present invention for selectively sensing a condition downhole.

Referring now to the drawing wherein like characters represent like or corresponding parts throughout the several figures. In FIG. 1, an early evaluation system (EES) drilling tool, designated generally by the numeral 10, is shown. The EES drilling tool measures formation pressure and downhole temperatures, which are transmitted uphole in real-time. The tool can be used for evaluation of subterranean formations and withstand drilling conditions or less strenuous conditions.

In FIG. 1, there is a conventional rotary rig 20 operable to drill a well bore through variant earth strata. Although FIG. 1 illustrates the use of a land-based well rig, other well rigs such as offshore or floating rigs can also take advantage of the EES drilling tool 10 described herein. The rotary rig 20 includes a mast of the type operable to support a traveling block and various hoisting equipment. The mast is supported upon a substructure 28, which straddles annular and ram blowout preventors 30. Drill pipe 32 is lowered from the rig through surface casing 34 and into a well bore 36. The drill pipe 32 extends through the well bore to a drill collar 38 that is fitted at its distal end with a conventional drill bit 40. The drill bit 40 is rotated by the drill string, or a submerged motor, and penetrates through the various earth strata.

The drill collar 38 is designed to provide weight on the drill bit 40 to facilitate penetration. Accordingly, such drill collars typically are composed with thick side walls and are subject to severe tension, compression, torsion, column bending, shock and jar loads. The drill collar 38 is connected to the EES tool 10 of the present invention. The EES tool has an outer tool 100 having centralizers 104, 106 and 108 (shown in FIG. 3). Contained in outer tool 100 is inner tool 200, having sensing and data electronics contained therein. The outer tool 100 of the EES tool 10 is connected to the drill pipe 32 at threaded connection 42 and connected to the drill collar 38 at threaded connection 44.

Figure 2:
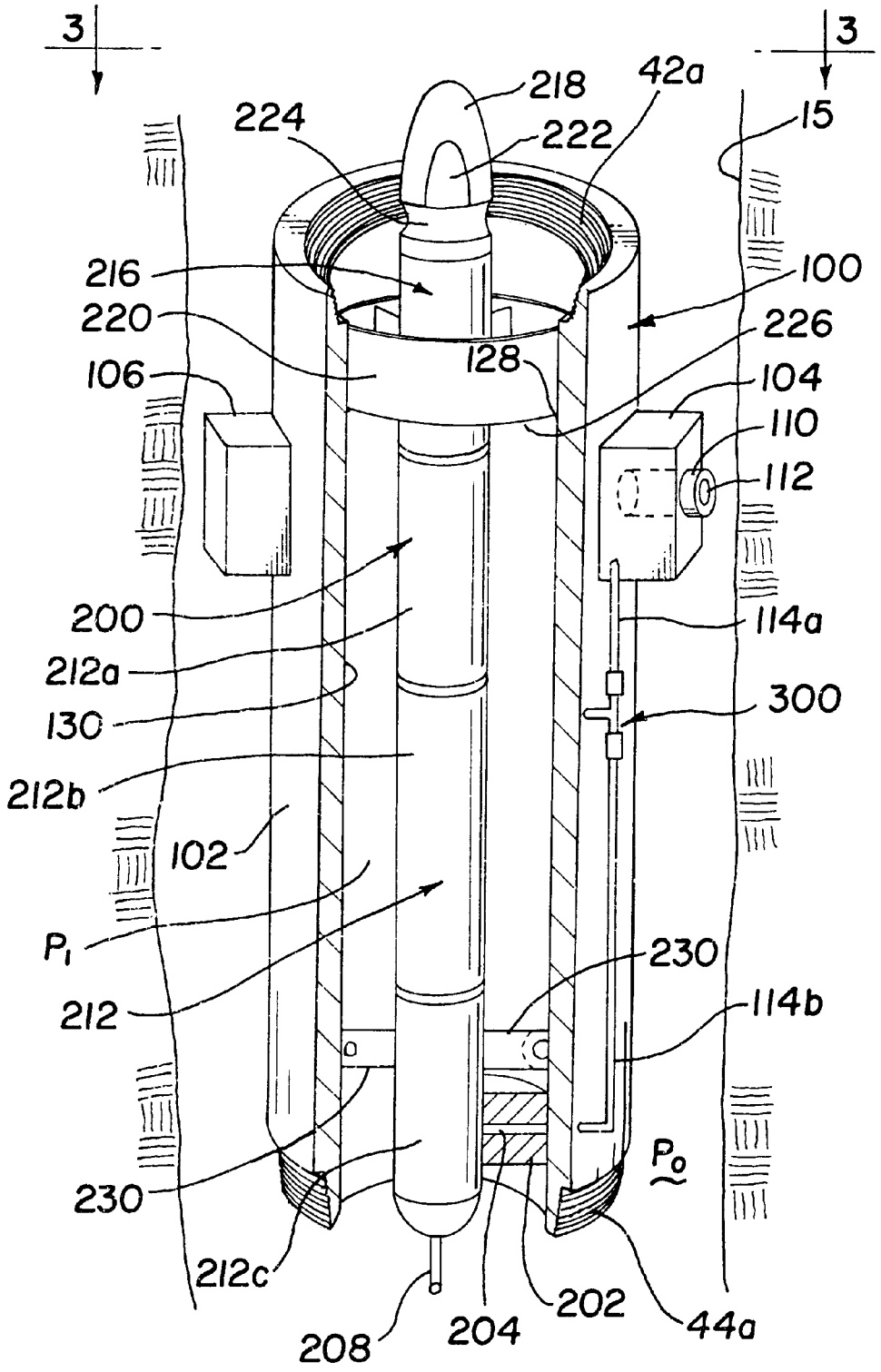
FIG. 2 is a perspective view of an embodiment of the invention with an inner tool positioned in the outer tool.

Referring to FIG. 2, the EES drilling tool has a tubular main housing that is connectable to a well work string. A probe 110 is extendible from the housing. The probe 110 is communicatively coupled to a sensor for measuring a condition in the well. To promote a sealing relation of the probe 110 with the formation surface 15, a scraper is also deployable from the main housing for removing formation debris and for smoothing the formation surface 15. It should be noted that although the EES drilling tool described herein is designed for deployment in a well drilling environment, the tool can also be deployed for conventional well evaluation.

The EES drilling tool 10 has an outer tool 100 containing inner tool 200. Outer tool 100 has a tubular main housing 102. Housing 102 is connectable to a well work string—such as drill pipe 32 (see FIG. 1)—for deployment in a subterranean well. The EES drilling tool 10 can be connected into the well string by conventional threaded connections 42*a* and 44*a*. Radially mounted on an external surface of housing 102 are centralizers 104, 106, and 108, respectively, best illustrated in FIG. 3. Centralizer 104 contains extendible probe 110, shown partially-extended for clarity.

The EES drilling tool 10 described herein has numerous advantages and desirable features through the complementary nature of outer tool 100 and inner tool 200. First, the inner tool 200 can be removed from the outer tool 100 while downhole, allowing retrieval of digital data and connate formation fluids contained therein. Second, the inner tool 200 can be replaced with another inner tool for reinsertion into the outer tool 100, allowing for repairs or another inner tool configured with a different suite of sensors for conducting other downhole measurements. Third, the outer tool can be sent downhole alone, with the inner tool inserted only when measurements are to begin, limiting exposure of the inner tool to the harsh drilling environment. Fourth, a wire line can be attached to the inner tool on the downhole trip, providing a high speed information data link to the surface and electrical power to the inner tool.

Still referring to FIG. 2, probe 110 has a port 112 defined therethrough. Port 112 is communicatively coupled to tool interface 202 through housing ports 114*a* and 114*b* defined in housing 102. Housing ports 114*a* and 114*b* are interlinked with a hydraulics assembly 300. Upon receipt of a command from the surface, hydraulics assembly 300 actuates probe 110, discussed later herein in detail.

Tool interface 202 defines an interface port 204 therethrough, which extends between the inner tool 200 and the outer tool 100. Interface port 204 is in communication with sensor devices in inner tool 200, described later in detail herein. As shown in FIG. 2, the pressure vessel housing 212 of inner tool 200 is formed of several lengths of vessel tubing 212*a*, 212*b* and 212*c*, accordingly, to contain the power supply and electronics for inner tool 200. The pressure vessel housing 212 is terminated by a tapered end 208 that extends below the tool body 200 to aid guiding the tool 200 into outer tool 100.

The opposite end of the pressure vessel housing 212 is terminated by a lander assembly 216 that substantially aligns the inner tool about the axis of the main housing 102. Lander assembly 216 has a bull-nose plug 218 that seals access to electrical battery connections, and a lander ring 220 that limits the downward travel of the inner tool 200 with respect to the outer tool 100.

Bull-nose plug 218 is paraboloid in shape and having dual-flats 222 for threadingly tightening the plug 218 onto pressure vessel housing 212. The paraboloid shape of the bull-nose plug 218 provides a smooth transitional surface to the drilling-fluid flow through the EES drilling tool 10, thus minimizing flow turbulence.

Defined about the base of bull-nose plug 218 is generally a groove 224. It should be noted that groove 224 can define profile surfaces for providing selective engagement of the bull-nose plug with mating-profile latch tools. Such latching tools are known by those skilled in the art and thus are not discussed in further detail herein. Latching tools can be springingly slid over the bull-nose plug 218 until engaging groove 224, thereby latching the plug 218. Upon pulling with a predetermined longitudinal force sufficient to dislodge inner tool 200, the inner tool 200 can be removed from the outer tool 100.

Lander ring 220 has a bottom lip 226 that shoulders on a ledge 128, which is defined on the inner surface 130 of housing 102. Lander ring 220 is releasably locked in relation with outer tool 100 to prevent longitudinal and rotational movement of inner tool 200 with respect to outer tool 100.

Figure 3:
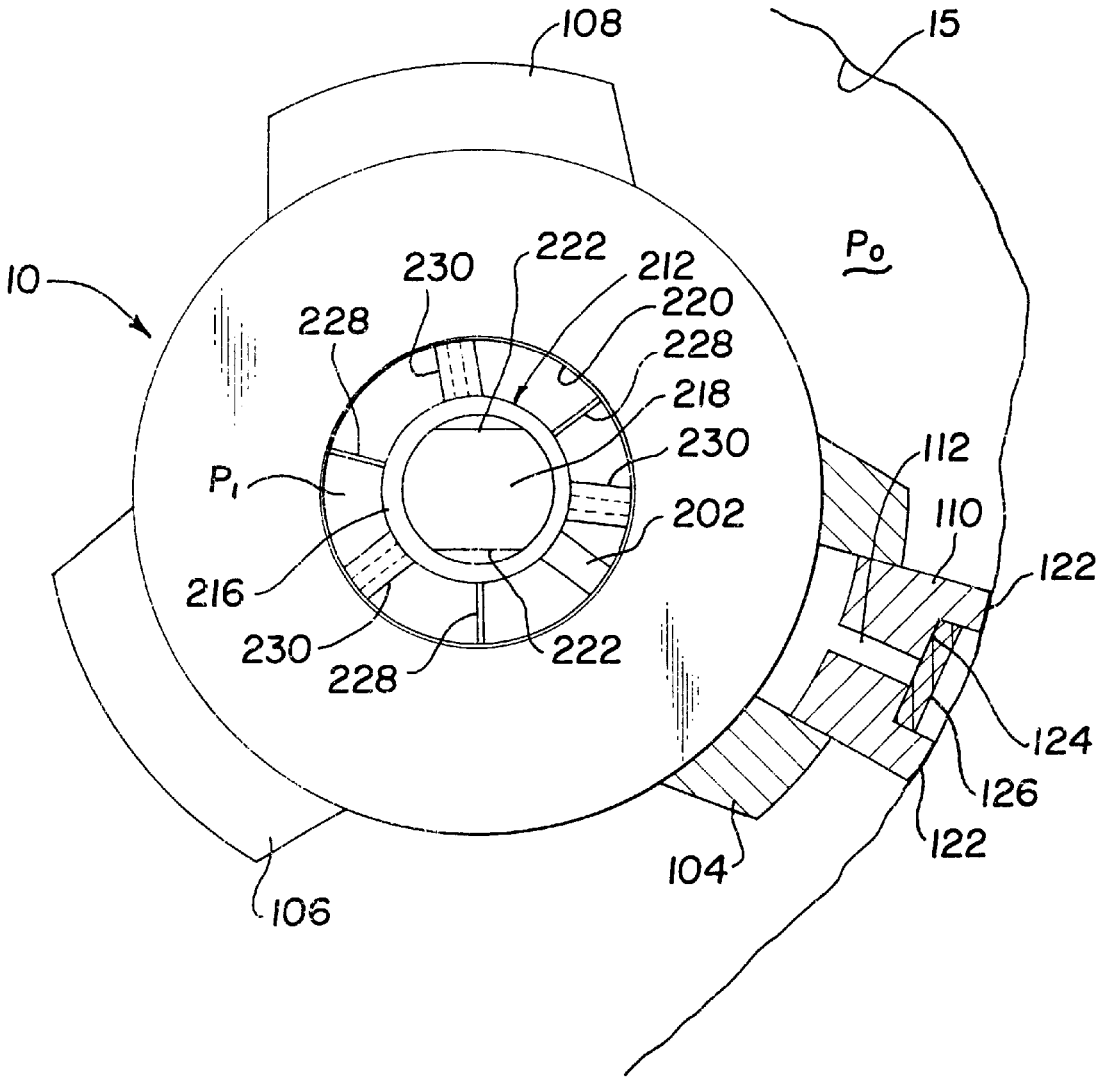
FIG. 3 is a top plan view with a partial cross section of the invention taken along line 3—3 in FIG. 2 showing the probe extended from the centralizer.

Referring to FIG. 3, a top plan view of EES drilling tool 10 is shown. Lander assembly 216 minimizes obstruction of drilling-fluid flow through the EES tool 10. Three radially-oriented lander plates 228—spaced at about one-hundred-twenty degrees with respect to each other—form the structural interconnection between lander assembly 216 and lander ring 220. As illustrated, the lander plates 228 have a marginal upper surface area and allow a laminar flow wherein the fluid particles or "streams" of the drilling-fluid tend to move parallel to the flow axis and to not mix or break into a diffused flow pattern.

Referring to FIGS. 2 and 3, the pressure vessel housing 212 has axially-extending standoffs 230 secured to vessel tubing 212*c*. The standoffs 230 are spaced-apart at about a 120-degree relation to each other. Standoffs 230 generally center pressure vessel housing 212 about the longitudinal axis of outer tool 100.

In FIG. 3, probe 110 is illustrated in a deployed position. Probe 110 has defined in the outer face surface a scraper 122. Scraper 122 is adapted to remove formation debris such as the filter cake or the layer of wet mud solids accumulated from the drilling-fluids and for smoothing the formation surface or well bore surface 15.

Smoothing the formation well bore surface 15 before applying the probe increases the reliability of the acquired formation data. For example, if the formation debris was not removed, the debris density can affect the outcome of formation permeability tests. Also, the debris can infiltrate the extracted or sampled formation fluids, thus contaminating the sample. Furthermore, providing a generally uniform sealing surface 15 also minimizes the likelihood of contaminating the formation sample with other well bore fluids.

About the probe port 112 is recessed surface 124. Secured over recessed surface 124 is mud screen 126, which is substantially contained within recessed surface to limit direct interaction of the mud screen 126 with the formation debris.

Referring to FIGS. 4A–4D, a schematic of the hydraulic assembly 300 is shown. Under drilling operation conditions, the EES drilling tool 10 can be exposed to a drilling-fluid velocity rate of about 50 fps (feet-per-second) therethrough. For example, an EES drilling tool 10 having a three-inch bore (about 7.6 cm) in the outer tool 100, an outer diameter of about 1.75 inches (4.45 cm) for the inner tool 200, and a 30-foot length (about 9.12 m), a fluid velocity of 49.88 fps (about 15.2 m/s) is sustained through the EES drilling tool 10 with an 11 ppg, 14 cp drilling-fluid and a mud flow rate about 725 gpm. With a thirty-foot length tool 10, the pressure drop across the tool is about 117.61 psi (about 910.8 kPa).

Hydraulic assembly 300 has a selector 302, which is responsive to control signals transmitted by pressure differentials in the inner bore of the EES tool and the well bore annulus. Selector 302 has a ratchet and spring assembly that is in mechanical communication with hydraulic valve 304 through ratchet arm 306. Valve 304 is in hydraulic communication with isolation member 308 through hydraulic line 310. Isolation member 308 has a floating piston 312 to isolate incoming well fluids 309 from comparatively delicate hydraulic components. Else, if less than pure fluids infiltrate the hydraulics, the hydraulic directional flow control 314 can plug and be rendered inoperable. The hydraulic fluid 311 (oil) on one side of the floating piston 312 of isolation member 308 is in hydraulic communication with directional flow control 314 through hydraulic line 313. Directional flow control 314 has a restrictor 316 and check valve 318.

Directional flow control 314 is a timing device for metering the outlet flow through hydraulic pathway 317 to piston 320, which engages a series of spool valves 322*a*, 322*b*, and 322*c*, respectively, which are operable by the actuator 324 of the piston 320.

The hydraulic assembly 300 is activated through a predetermined sequence of annular and inner bore pressure differentials effected by controlling the drilling-fluid circulation. Referring again to FIGS. 2 and 3, drilling-fluid is pumped through the bore of the drill string, creating a high pressure environment, $P_1$. The drilling-fluid is forced through the drill bit and returns through the annular space of the well, creating a low pressure annulus environment $P_0$. The resulting pressure differential retains the probe components within the EES tool 10.

Referring to FIGS. 4A–4D, tool bore pressure P is the pressure in the inner diameter of the outer tool 100. During drilling operations, tool bore pressure P has a high pressure value of $P_1$. When a desired formation is reached for testing, the drill string is halted.

The hydraulic assembly 300 is activated or manipulated by a signal of a signal set transmitted from the surface. The signal set can have two distinct signals—one for probe and scraper deployment, another for return. Preferably, the signal set has at least one signal, which can be used to initiate the mechanical sequences to deploy or return the probe 110 and the scraper 122, accordingly. It should also be noted that other signaling variations can be devised by those skilled in the art, such as using only one signal to simply initiate probe and scraper deployment, leaving a hydraulic or mechanical timing mechanism to return the probe and the scraper after a set time period elapses for test completion.

Further, the signal set can be transmitted using varying signaling techniques, for example drilling-fluid circulation rate manipulation, acoustic transmission, electromechanical signaling, electromagnetic signaling or the like. Signal transmission by manipulation of the drilling-fluid circulation rates is preferred due to its relative simplicity.

Thus, after the drill string is halted, the signal from the signal set is transmitted from the surface through the circulating drilling-fluid by modulating the drilling-fluid flow rate in a prescribed and predetermined manner. The tool bore pressure P now has a value of $P_0$.

Selector 302 triggers in response to this pressure change, actuating valve 304 through piston 306, throwing the valve 304 into the second position ($P=P_1$). At this point, the hydraulic assembly 300 is in a "set" position. The drilling-fluid circulation is then restarted. As pressure value P increases to high pressure value $P_1$, drilling-fluid is conveyed through hydraulic line or pathway 310 to isolation member 308, wherein floating piston 312 transfers the hydraulic energy to the hydraulic fluid 311.

Again, it is highly desirable to continue drilling-fluid circulation while evaluating the subterranean formation. Preferably, the drilling-fluid rate is sufficient to sustain the beneficial aspects of limiting the tendency of the well string to become stuck or of a well blowout, while not circulating at a rate detrimental to the inner tool 200 and components extending from outer tool 100.

Figures 4A, 4B, 4C, 4D:
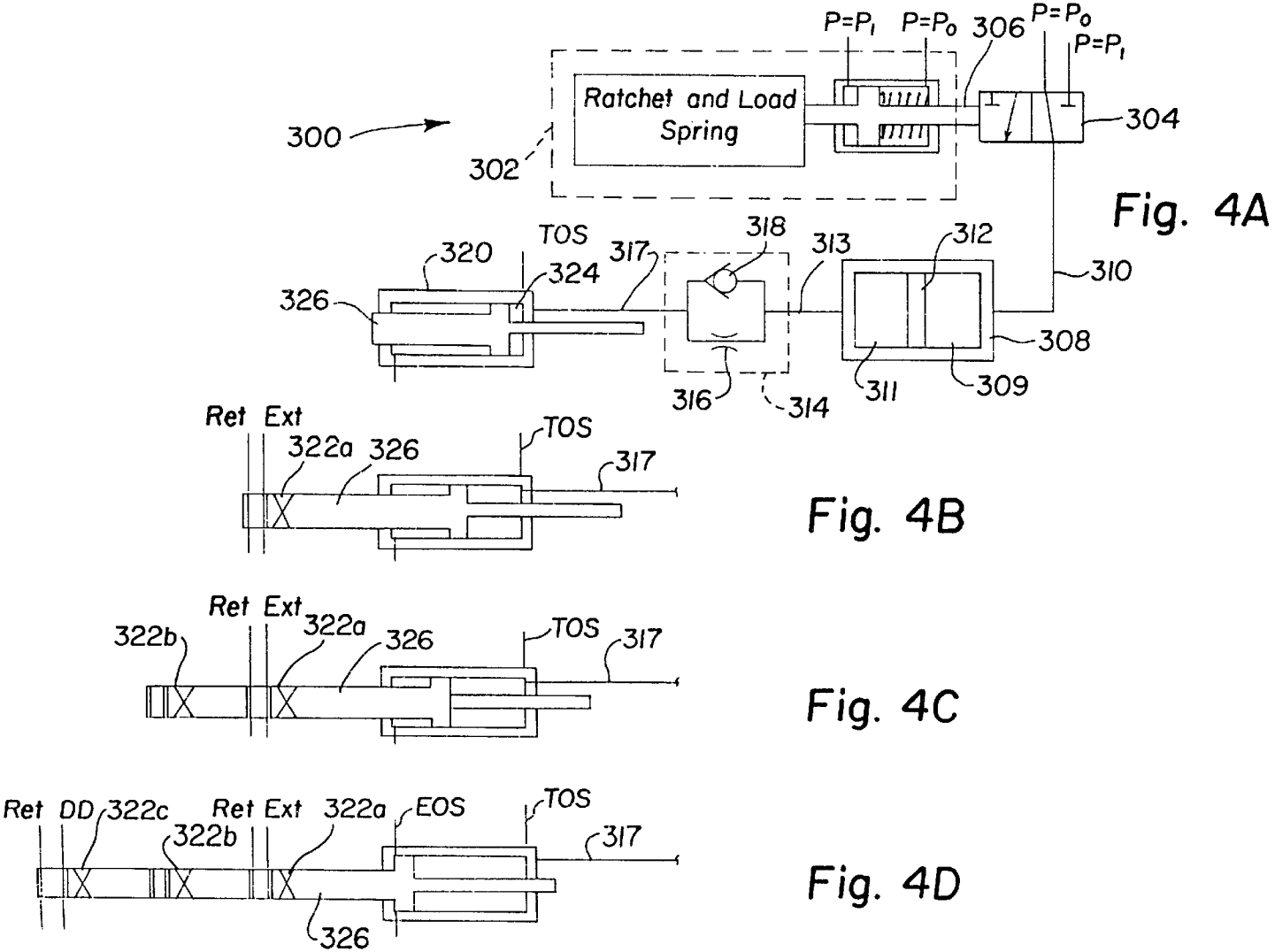
FIGS. 4A–4D is a hydraulic schematic for extending the scraper and the probe of the invention.

Still referring to FIG. 4A, hydraulic fluid 311 is conveyed through hydraulic line 317 to piston chamber 324 of piston 320. Restrictor 316 slows the extension rate of piston 320 towards the "end-of-stroke" ("EOS"), best shown in FIG. 4D. Preferably, a restrictor is selected that allows the piston to travel to "end-of-stroke" within about ten minutes.

Referring to FIG. 4B, actuator 326 is extended to the first spool valve 322*a*. Spool valve 322*a* controls extension of the probe 110, shown in FIGS. 2 and 3.

For scraping scraper 122, a sufficient force exerted the probe against the well bore surface 15 is at least 500 psi (about 3447 kPa). The drill string is then rotated clockwise at least one revolution, thereby scraping and generally smoothing the formation surface 15 for promoting a sealing relation of the probe 110 with the formation surface 15. It should be noted that the scraping can be effected by other manipulations of the drill string, such as jogging the string longitudinally, or in a combination of rotational and longitudinal movements. At full extension, probe 110 engages the formation surface 15 at a greater force than for scraping to promote a sealing relation of the probe port 112 with the formation surface 15. A sufficient force is about 700 psi (about 4826 kPa).

Referring to FIG. 4C, actuator 326 continues traveling with respect to the hydraulic flow rate designated by restrictor 316 and engages second spool valve 322*b*. Actuation of second spool valve 322*b* causes the internal pump of the EES drilling tool 10 to generate a first pressure drawdown/buildup cycle at the interface of the probe 110 with the subterranean formation being evaluated.

Referring to FIG. 4D, actuator 326 engages third spool valve 322*c*. Spool valve 322*c* generates a second pressure drawdown/buildup cycle at the interface of the probe 110 with the subterranean formation being evaluated. It should be noted that the formation can be sampled simply once, or more than the two times to obtain the permeability evaluation of the subterranean formation. However, it is preferable that the formation be sampled two times for accuracy and to limit later samplings of the formation needed due to questionable evaluation results.

With the testing complete, a deactivation/tool-reset signal is sent to the hydraulic assembly through the drilling-fluid. A suitable signal is provided by stopping circulation of the drilling-fluid.

Recall that after and during the actuation of the hydraulic assembly 300 as set out above, the mud pumps of the well site are circulating drilling-fluids through the well. With the piston actuator at the EOS position, illustrated in FIG. 4D, the mud pump is stopped thus ceasing circulation of the drilling-fluid. In response to the resulting pressure transition, the selector 302 resets and valve 304 is reset to the setting $P=P_0$.

Upon reactivating the mud pumps, the pressure differential between the outer tool bore and the well annulus returns the extended probe 110 and scraper 122 to the outer tool 100. The return rate is a flnction primarily of the pressure differential because the check valve 318 allows unfettered hydraulic flow into the isolation member 308 by reciprocal movement of floating piston 312. Upon completion of the return, piston actuator 326 is reset to the top-of-stroke ("TOS") position for redeployment.

Figure 5:
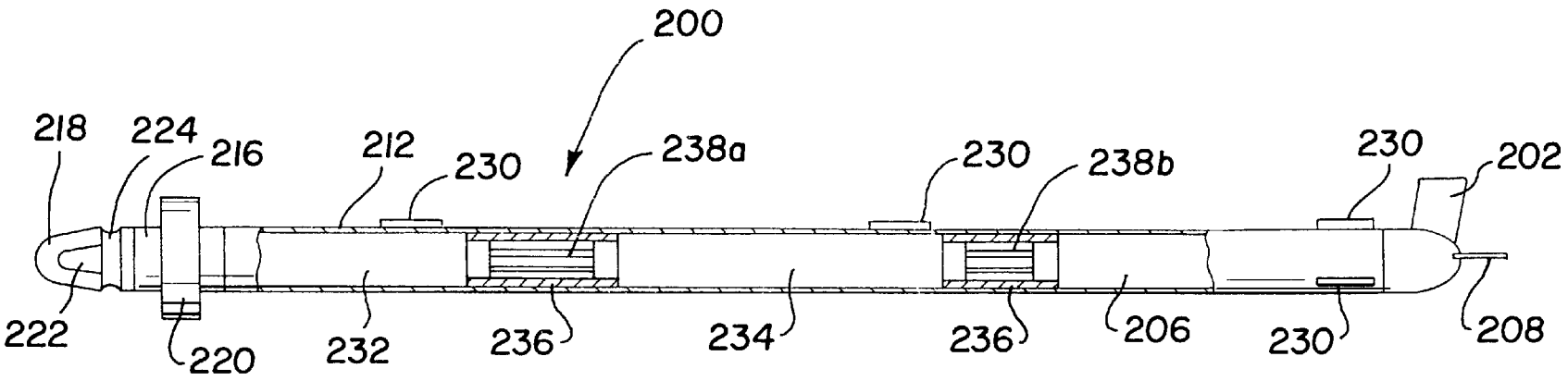
FIG. 5 is a partial cross section view showing the inner tool of the invention.

Referring to FIG. 5, an elevation view of the inner tool 200 is shown. In the preferred embodiment, inner tool 200 has a battery portion 232, a sensor electronics portion 234 and a sensor portion 206. The portions are separated and mechanically buffered to reduce vibration and shock with shock plugs 236. The portions are interconnected with wire harnesses 238*a* and 238*b* having a plurality of electrical conductors.

Battery portion 232 preferably has rechargeable batteries that are electrically assembled as a battery pack to power the electronics portion 234. The batteries are configured to provide proper operating voltage and current.

Figure 6:
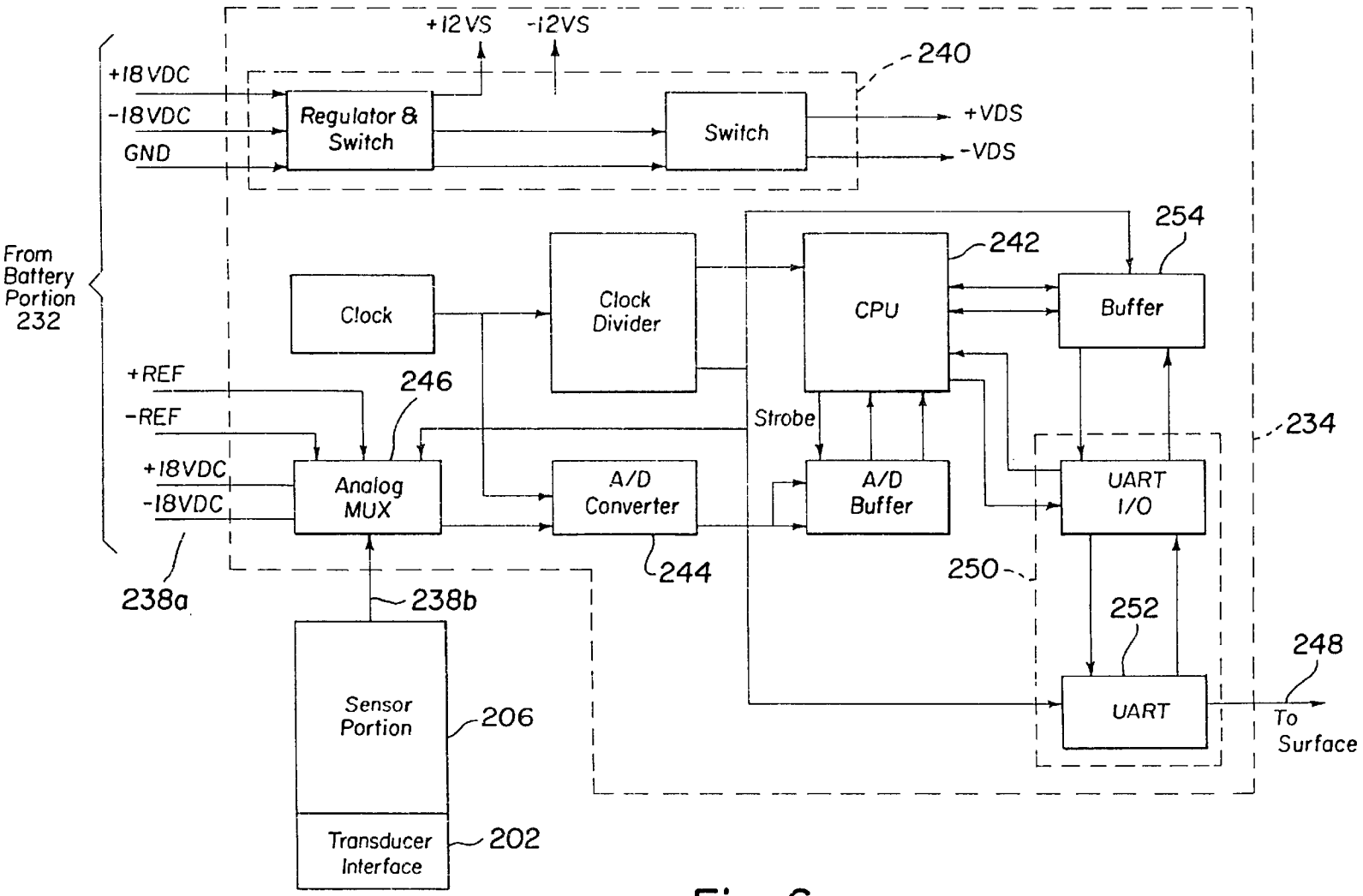
FIG. 6 is an electrical diagram showing the sensor unit's electrical components.

Referring to FIG. 6, an electrical block diagram of sensor electronics portion 234 is shown. In this portion, formation data is supplied from the sensor portion 206 to the electronics portion 234 through wire harness 238*b*. The term sensor, as used herein, is a device capable of being actuated by electrical or mechanical signals from one or more transmission systems or media and of supplying related electrical or mechanical signals to one or more other transmission systems or media, accordingly, wherein it is common that the input and output energies are of different forms. In the present embodiment, such sensors are transducers used to detect pressure and temperature values in the well bore.

Power is provided by battery portion 232 through wire harness 238*a*. The electronics portion 234 has a power regulation circuitry 240, a microcontroller 242, and an analog-to-digital (A/D) converter 244. Microcontrollers are generally a onechip integrated system embedded in a single application, thus having peripheral features such as program and data memory, input/output ports and related subsystems for the EES drilling tool's computer aspects. A microcontroller, as opposed to a microprocessor, is preferable in the present embodiment due to these features.

Upon receipt of a pressure pulse command by sensor portion 206 or expiration of a time-out period, whichever is selected, the electronics portion 234 powers up, obtains the data from the sensor unit 206 and stores the data for transmission in the data buffer 254. If a data link is available through conductor 248, the data can be transmitted to the surface. Otherwise, the data can be retained in the data buffer 254, which can then be retrieved later when the inner tool 200 is removed from the EES tool 10 when downhole or at the surface.

Sensor portion 206 interfaces into electronics portion 234 through an analog multiplexer ("MUX") 246. Electronic portion 234 interfaces with the surface through a conductor or transmission medium 248 through a universal-asynchronous-receiver-transmitter ("UART") communications interface 250. The interface has an integrated circuit 252 containing both the receiving and transmitting circuits required for asynchronous serial communication. Thus, the electronics portion 234 can communicate with another system on the surface through a simple wire connection (or other suitable communications medium).

Figure 7:
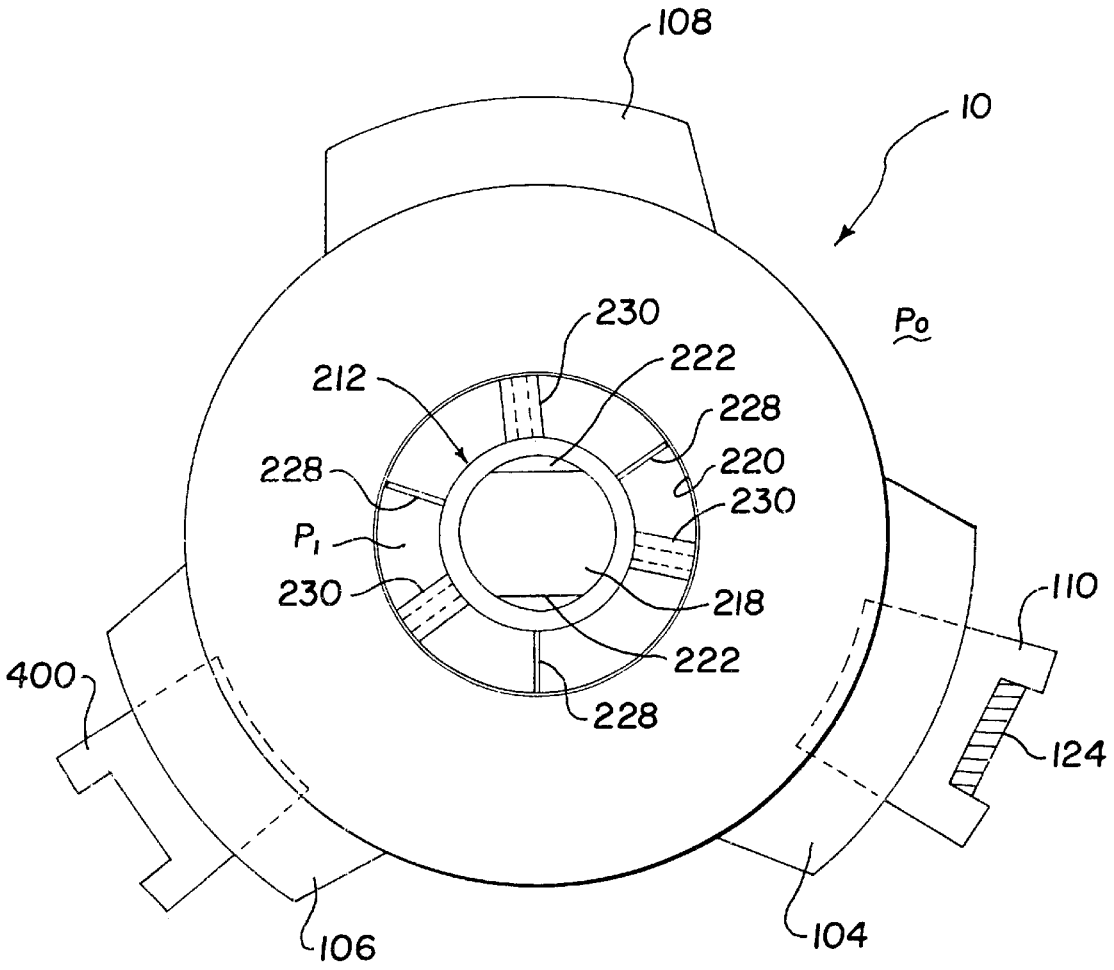
FIG. 7 is another embodiment of the invention having a separate scraper and probe.

Referring to FIG. 7, another embodiment of the outer tool having a separately extendible scraper 400 and probe 110 is shown. Extendible scraper 400 is extended with a force of at least 500 psi (about 3447 kPa) for removing formation debris and smoothing the subterranean formation surface 15. Probe 110 is extended with a force of at least 700 psi (about 4826 kPa).

Figure 8:
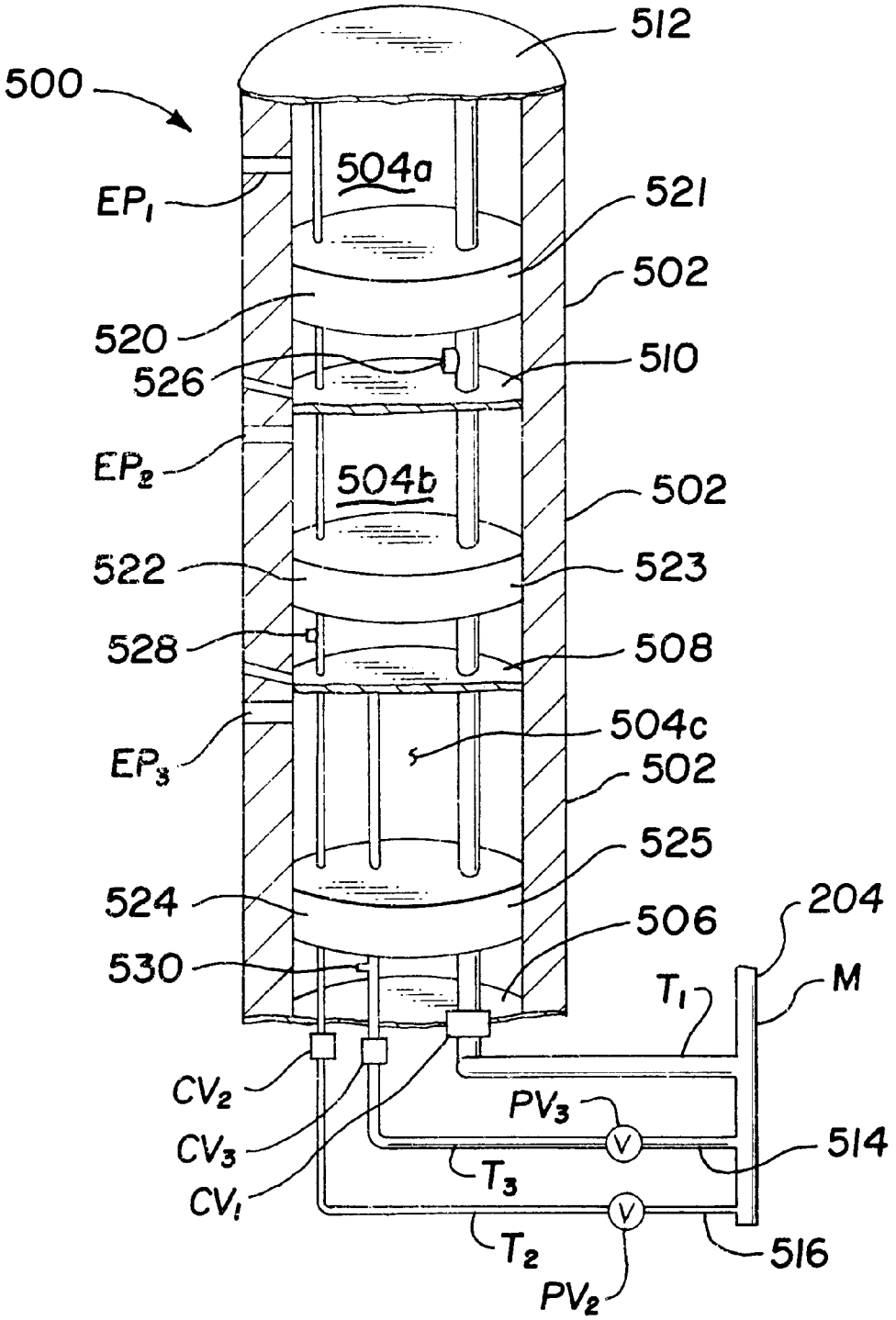
FIG. 8 is a well fluid sampling chamber that can be used with the present invention.

Referring to FIG. 8, a formation sampling vessel 500 is shown. Sampling vessel 500 is connectable to the inner tool 200 between sensor unit 206 and tapered end 208 to allow additional evaluation tests. The sampling vessel 500 is pressure activated and retrieves formation samples for PVT (pressure-volume-temperature) analysis. This test allows the collection of a formation sample prior to or in lieu of a well test, allowing further preliminary evaluations of the well without the logistical burden of comprehensive well tests.

Sampling vessel 500 has a segmented tubular housing 502 with distinct chambers 504*a*, 504*b* and 504*c* defined therein with chamber partitions 506, 508, 510 and 512, accordingly, for storing formation fluid samples retrieved from the well bore surface 15. The volume of chambers 504*a*, 504*b* and 504*c* can vary with respect to each other.

The well bore formation fluid enters the sampling vessel 500 through a manifold M. Manifold M is in fluid communication with interface port 204 (see FIG. 2), which is defined in tool interface 202. Manifold M is connected to a plurality of fluid transmission tubes $T_1$, $T_2$ and $T_3$ in fluid communication with chambers 504*a*, 504*b*, and 504*c*, respectively, through chamber partition 506.

Accordingly, extracted formation fluids seek the path of least resistance, which is the largest unrestricted diameter provided by tube $T_1$. Pressure relief valves $PV_2$ and $PV_3$ on the tube $T_2$ manifold input 516 and tube $T_3$ manifold input 514, respectively, provide additional back pressure resistance to the fluid and prevent formation fluid from entering the specific tube flowing to its chamber. Each pressure relief valve $PV_2$ and $PV_3$ is sized differently, with the smallest tube diameter having the smallest valve. Each successive pressure relief is of a different value, each requiring more pressure than the preceding valve to trigger it.

Chambers 504*a*, 504*b* and 504*c* contain an equalization port $EP_1$, $EP_2$, and $EP_3$, respectively, and a movable piston 520, 522, and 524. Transmission tubes $T_1$ and $T_2$ are axially spaced-apart and extend the length of sampling vessel 500 to provide a longitudinal travel path for pistons 520, 522 and 524. Fluid transmission tubes $T_1$, $T_2$ and $T_3$ have an exit port 526, 528 and 530, respectively. Exit port 526 is situated between piston 520 and chamber partition 510. Exit port 528 is situated between piston 522 and chamber partition 508. Exit port 530 is situated between piston 524 and chamber partition 506.

As the fluid flows up the tube $T_1$, it will exit the fluid port 526 and begin to move the piston 520. As the piston 520 travels towards chamber partition 512, trapped fluids—such as atmospheric gases or tool lubrication liquids—are exhausted through the chamber equalizing port $EP_1$. The formation fluid flow to the chamber 504*a* is unidirectional, because a check valve $CV_1$ prevents back-flow. The fluid continues to fill the volume of chamber 504*a* until equalizing port $EP_1$ is effectively sealed by circumferential surface 521 of piston 520.

When fluid pressure is equalized in the chamber 504*a*, the fluid input pressure at inputs 514 and 516 increases until a sufficient pressure level is reached to overcome the flow resistance of pressure relief valve $PV_3$ and the size of the tubing leading to chamber 504*c*. The formation fluid flow to the chamber 504*c* is unidirectional, because check valve $CV_3$ prevents back-flow. The fluid continues to fill the volume of chamber 504*c* until equalizing port $EP_3$ is effectively sealed by circumferential surface 523 of piston 522. Thus, chamber 504*c* is filled in accordance with the manner that chamber 504*a* is filled. When fluid pressure at input 516 increases until a sufficient pressure level is reached to overcome the flow resistance of pressure relief valve $PV_2$ and the size of the tubing $T_2$ leading to chamber 504*b*, that chamber begins to fill. The formation fluid flow to the chamber 504*b* is unidirectional, because check valve $CV_2$ prevents back-flow. The fluid continues to fill the volume of chamber 504*b* until equalizing port $EP_2$ is effectively sealed by circumferential surface 525 of piston 524. Thus, chamber 504*b* is filled with sampled formation fluids. The above sequence is similarly conducted until this chamber is filled. With the sampling vessel chambers filled, the inner tool 200 can be removed using a latch tool to engage the bull-nose plug 218, as discussed above.

The description and figures of the specific examples above do not point out what an infringement of this invention would be, but are to provide at least one explanation of how to make and use the invention. Numerous modifications and variations of the preferred embodiments can be made without departing from the scope and spirit of the invention.

Thus, the limits of the invention and the bounds of the patent protection are measured by and defined in the following claims.

Having described the invention, what is claimed is:

1. A well tool for evaluating a subterranean formation through an exposed formation surface, the well tool comprising:

a tubular main housing connectable to a well work string;

a probe extendible from said main housing, said probe communicatively coupled to a sensor for measuring a condition in the well; and a scraper extendible from said main housing for removing formation debris and smoothing a formation surface region, thereby promoting a sealing relation of said probe with the formation surface region, wherein said probe and said scraper can be manipulated by a signal set transmitted from the surface, wherein said sensor is a longitudinally extending sensor unit having a transducer and a sensor electronics circuit electrically connectable to said transducer, said sensor electronics circuit having a terminal for electrical connection to a power supply and having a microcontroller, an analog-to-digital conversion circuit, and a communications interface circuit, said sensor unit having an external diameter which is less than the internal diameter of the housing;

said main housing unit has an internal bore for removably receiving said sensor unit; and said probe is communicatively coupled to said transducer fortranslating a condition in the well into a representative signal interpretable by said microcontroller.

2. The well tool of claim 1 wherein said signal set transmitted from the surface comprises variations in pressure.

3. A well tool for evaluating a subterranean formation through an exposed formation surface, the well tool comprising:

a tubular main housing connectable to a well work string;

a probe extendible from said main housing, said probe communicatively coupled to a sensor for measuring a condition in the well; and a scraper extendible from said main housing for removing formation debris and smoothing a formation surface region, thereby promoting a sealing relation of said probe with the formation surface region, wherein said probe and said scraper can be manipulated by a signal set transmitted from the surface, wherein said scraper and said probe are separately extendible from said main housing.

4. The well tool of claim 3 wherein said sensor comprises:

a pressure transducer;

a sensor electronics circuit electrically connectable to said pressure transducer, said electronics circuit having a microcontroller, an analog-to-digital conversion circuit, and a communications interface circuit;

a direct-current power supply electrically connectable to said electronics circuit for energizing said electronics circuit; and a pressure vessel for containing said pressure transducer, said sensor electronics circuit and said power supply, said pressure vessel is remotely removable from said inner bore of said main housing.

5. The well tool of claim 3 wherein said signal set is transmitted from the surface through a circulated drilling fluid.

6. A well tool for evaluating a subterranean formation through an exposed formation surface, the well tool comprising:

a tubular main housing connectable to a well work string;

a probe extendible from said main housing, said probe communicatively coupled to a sensor for measuring a condition in the well; and a scraper extendible from said main housing for removing formation debris and smoothing a formation surface region, thereby promoting a sealing relation of said probe with the formation surface region, wherein said probe and said scraper can be manipulated by a signal set transmitted from the surface, wherein said sensor is centrally contained within an inner bore of said main housing and is selectively removable from said main housing.

7. The well tool of claim 6 further comprising:

a port defined through said main housing and said probe for placing said sensor in communication with the subterranean formation.

8. The well tool of claim 6 wherein said sensor comprises:

a pressure transducer;

a sensor electronics circuit electrically connectable to said pressure transducer, said electronics circuit having a microcontroller, an analog-to-digital conversion circuit, and a communications interface circuit;

a direct-current power supply electrically connectable to said electronics circuit for energizing said electronics circuit; and a pressure vessel for containing said pressure transducer, said sensor electronics circuit and said power supply, said casing is remotely removable from said inner bore of said main housing.

9. The well tool of claim 7 further comprising:

a formation sampling vessel having a fluid manifold in fluid communication with a plurality of fluid transmission tubes, each of said fluid transmission tubes having a distinguishable diameter and in fluid communication with a chamber of a plurality of chambers for containing a formation fluid when said manifold is in fluid communication with said port.

10. The well tool of claim 7 wherein said scraper and said probe are separately extendible from said main housing.

11. The well tool of claim 7 wherein said probe is hydraulically actuated.

12. The well tool of claim 1 further comprising:

a formation sampling vessel having a fluid manifold in communication with a plurality of fluid transmission tubes, each of said fluid transmission tubes having a distinguishable diameter and in fluid communication with a chamber of a plurality of chambers for containing a formation fluid when said manifold is in fluid communication with said port.

13. A drill string tool for evaluating a subterranean formation in a drilling environment through an exposed formation surface, the tool comprising:

a tubular main housing connectable to a well work string; and a probe extendible from said main housing, said probe communicatively coupled to a sensor for measuring a condition in the well, wherein said probe can be manipulated by a signal set transmitted from the surface, and wherein said sensor comprises:

a pressure transducer;

a sensor electronics circuit electrically connectable to said pressure transducer, said electronics circuit having a microcontroller, an analog-to-digital conversion circuit, and a communications interface circuit;

a direct-current power supply electrically connectable to said electronics circuit for energizing said electronics circuit; and a pressure vessel housing for containing said pressure transducer, said sensor electronics circuit and said power supply, said pressure vessel housing is remotely removable from said inner bore of said main housing.

14. The drill string tool of claim 13 wherein said signal set transmitted from the surface comprises variations in pressure.

15. The drill string tool of claim 13 wherein said signal set is transmitted from the surface through a circulated drilling fluid.

16. A drill strip tool for evaluating a subterranean formation in a drilling environment through an exposed formation surface, the tool comprising:

a tubular main housing connectable to a well work string; and a probe extendible from said main housing, said probe communicatively coupled to a sensor for measuring a condition in the well, wherein said probe can be manipulated by a signal set transmitted from the surface, and wherein said sensor is a longitudinally extending sensor unit having a transducer and a sensor electronics circuit electrically connectable to said transducer, said sensor electronics circuit having a terminal for electrical connection to a power supply and having a microcontroller, an analog-to-digital conversion circuit, and a communications interface circuit, said sensor unit having an external diameter which is less than the internal diameter of the housing;

said main housing unit has an internal bore for removably receiving said sensor unit; and said probe is communicatively coupled to said transducer for translating a condition in the well into a representative data signal interpretable by said microcontroller.

17. A drill string tool for evaluating a subterranean formation in a drilling environment through an exposed formation surface, the tool comprising:

a tubular main housing connectable to a well work string; and a probe extendible from said main housing, said probe communicatively coupled to a sensor for measuring a condition in the well, wherein said probe can be manipulated by a signal set transmitted from the surface, and wherein said sensor is centrally contained within an inner bore of said main housing and is selectively removable from said main housing.

18. The drill string tool of claim 17 further comprising:

a port defined through said main housing and said probe for placing said sensor in communication with the subterranean formation.

19. The drill string tool of claim 17 wherein said sensor comprises:

a pressure transducer;

a sensor electronics circuit electrically connectable to said pressure transducer, said electronics circuit having a microcontroller, an analog-to-digital conversion circuit, and a communications interface circuit;

a direct-current power supply electrically connectable to said electronics circuit for energizing said electronics circuit; and a pressure vessel housing for containing said pressure transducer, said sensor electronics circuit and said power supply, said pressure vessel housing is remotely removable from said inner bore of said main housing.

20. The drill string tool of claim 18 further comprising:

a formation sampling vessel having a fluid manifold in fluid communication with a plurality of fluid transmission tubes, each of said fluid transmission tubes having a distinguishable diameter and in fluid communication with a chamber of a plurality of chambers for containing a formation fluid when said manifold is in fluid communication with said port.

21. The drill string tool of claim 18 wherein said probe is hydraulically actuated.

22. The drill string tool of claim 18, further comprising a scraper extendible from said main housing for removing formation debris and smoothing a formation surface region, wherein said scraper and said probe are separately extendible from said main housing.

23. A method of evaluating a well bore formation, the method comprising the steps of:

providing an early evaluation tool on a service string, the early evaluation drilling tool having a tubular main housing connectable to the well work string, a probe extendible from the main housing, the probe communicatively coupled to a sensor for measuring a condition in the well, and a scraper extendible from the main housing for removing formation debris and smoothing a formation surface region, thereby promoting a sealing relation of the probe with the formation surface region;

extending the scraper against an inner surface of the well bore formation in response to a first signal transmitted from the surface;

scraping a surface region of the well bore formation with the scraper by manipulating the well drill string, thereby decreasing well bore debris and smoothing a region of the formation surface region;

extending the probe into a sealing relation with the scraped surface region;

sensing a condition of a formation fluid with the probe; and returning the scraper and the probe into the main housing thereby disengaging the formation surface.

24. The method of claim 23 wherein said returning step comprises receiving a second signal transmitted from the surface and returning the scraper and the probe to the main housing in response to the second signal.

25. A method of evaluating a well bore formation in a well drilling environment, the method comprising the steps of:

providing an early evaluation drilling tool in a well drill string having a drill bit, the early evaluation drilling tool having a tubular main housing connectable to the well work string, and a probe extendable from the main housing, the probe communicatively coupled to a sensor for messing a condition in the well;

scraping a surface region of the well bore formation with a scraper extendible from the main housing by manipulating the well drill string, thereby decreasing well bore debris and smoothing a formation surface region for promoting a sealing relation of the probe with the formation surface region;

extending the probe into a sealing relation with the formation surface region in response to a first signal from a signal set transmitted from the surface;

sensing a condition of a formation fluid with the probe; and returning the probe into the main housing.

26. The method of claim 25 wherein said returning step comprises receiving a second signal from the signal set transmitted from the surface and returning the probe into the housing in response to the second signal.

* * * * *